US009304493B2

(12) United States Patent
Stranczl et al.

(10) Patent No.: US 9,304,493 B2
(45) Date of Patent: Apr. 5, 2016

(54) FLEXIBLE ESCAPEMENT MECHANISM HAVING A BALANCE WITH NO ROLLER

(71) Applicant: Nivarox-FAR S.A., Le Locle (CH)

(72) Inventors: Marc Stranczl, Nyon (CH); Thierry Hessler, St-Aubin (CH); Andres Cabezas Jurin, Yverdon (CH); Davide Sarchi, Renens (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/388,641

(22) PCT Filed: Mar. 27, 2013

(86) PCT No.: PCT/EP2013/056581

§ 371 (c)(1),
(2) Date: Sep. 26, 2014

(87) PCT Pub. No.: WO2013/144238

PCT Pub. Date: Oct. 3, 2013

(65) Prior Publication Data

US 2015/0043313 A1 Feb. 12, 2015

(30) Foreign Application Priority Data

Mar. 29, 2012 (EP) ..... 12162030

(51) Int. Cl.
*G04B 15/00* (2006.01)
*G04C 5/00* (2006.01)
(Continued)

(52) U.S. Cl.
CPC ..... *G04B 15/14* (2013.01); *G04B 15/00* (2013.01); *G04B 15/02* (2013.01); *G04B 15/06* (2013.01); *G04B 15/08* (2013.01); *G04B 15/12* (2013.01)

(58) Field of Classification Search
CPC ..... G04B 15/00; G04B 15/02; G04B 15/06; G04B 15/14
USPC ..... 368/124, 127, 129–131
See application file for complete search history.

(56) References Cited

U.S. PATENT DOCUMENTS 443,684 A * 12/1890 Riefler ..... G04B 15/02 368/127
1,336,263 A 4/1920 Tideman
(Continued)

FOREIGN PATENT DOCUMENTS

CH 60813 7/1912
CH 383 887 7/1964
(Continued)

OTHER PUBLICATIONS

International Search Report Issued Jul. 4, 2013 in PCT/EP13/056581 Filed Mar. 27, 2013.

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A timepiece escapement mechanism, including a balance having no roller and an escape wheel, between which impulses are transmitted by a flexible, single-piece mechanism, connected by at least one flexible strip to a fixed structure or to the wheel. Oscillation is maintained by a balance spring ending in a balance spring stud which is mobile during operation, and which is guided by a flexible guide member with flexible strips, and whose center of rotation is coaxial to the balance, the balance spring stud receiving a pin which is mobile in a cam path of the wheel. During the oscillations, the balance spring stud is moved relative to its locking position under action of force exerted by the balance spring, and the pin maintains and regulates the oscillation.

13 Claims, 1 Drawing Sheet

(51) Int. Cl.

| | |
|---|---|
| ***G04B 15/14*** | (2006.01) |
| ***G04B 15/02*** | (2006.01) |
| ***G04B 15/06*** | (2006.01) |
| ***G04B 15/08*** | (2006.01) |
| ***G04B 15/12*** | (2006.01) |

(56) References Cited

U.S. PATENT DOCUMENTS

| | | | | | |
|---|---|---|---|---|---|
| 1,934,611 | A * | 11/1933 | Franz | G04B 15/02 | 74/1.5 |
| 2,092,216 | A * | 9/1937 | Junghans | G04B 15/08 | 368/129 |
| 2,924,102 | A * | 2/1960 | Drouhot | G04B 15/00 | 368/125 |
| 3,736,743 | A * | 6/1973 | Koike | G04B 17/045 | 368/168 |
| 2008/0117721 | A1 * | 5/2008 | Glashutte | G04B 18/026 | 368/175 |
| 2012/0113763 | A1 * | 5/2012 | Queval | G04B 43/002 | 368/127 |
| 2012/0300596 | A1 * | 11/2012 | Koda | G04B 15/06 | 368/131 |
| 2013/0070570 | A1 * | 3/2013 | Colpo | G04B 15/06 | 368/127 |
| 2014/0307530 | A1 * | 10/2014 | Beugin | G04B 15/08 | 368/127 |

FOREIGN PATENT DOCUMENTS

| | | |
|---|---|---|
| DE | 552 368 | 6/1932 |
| DE | 20 2009 008 527 | 8/2010 |
| EP | 1 967 919 | 9/2008 |
| EP | 2 037 335 | 3/2009 |
| EP | 2 105 806 | 9/2009 |
| EP | 2 221 677 | 8/2010 |
| EP | 2 450 755 | 5/2012 |
| FR | 690 365 | 9/1930 |
| FR | 1 005 726 | 4/1952 |
| WO | 2011 120180 | 10/2011 |

* cited by examiner

FLEXIBLE ESCAPEMENT MECHANISM HAVING A BALANCE WITH NO ROLLER

CROSS-REFERENCE TO RELATED APPLICATIONS

This is a National Phase Application in the U.S. of International Patent application PCT/EP2013/056581 filed Mar. 27, 2013 which claims priority on European Patent Application 12162030.6 filed Mar. 29, 2012. The entire disclosure of each of the above patent applications are hereby incorporated by reference.

FIELD OF THE INVENTION

The invention concerns a timepiece escapement mechanism including a balance having no roller and an escape wheel, between which impulses are transmitted by a flexible, single-piece mechanism, connected by at least one flexible strip to a fixed structure, or to said wheel.

The invention also concerns a timepiece movement including a fixed structure and at least one mechanism of this type.

The invention also concerns a timepiece including a fixed structure and at least one mechanism of this type, and/or at least one timepiece movement of this type.

The invention concerns the field of timepiece mechanisms, and more specifically escapement mechanisms.

BACKGROUND OF THE INVENTION

Watchmaking performance requires high precision movements, with minimum space requirements, and a reduced number of components, in order to control production, assembly and adjustment costs. "LIGA" or "DRIE" technologies can produce flexible, precise components, and challenge conventional architectures, which are characterized by a high number of components and complex adjustments.

WO Patent No 2011/120180 A1 in the name of Rolex SA discloses a pallet type brake lever, with two arms, each provided with a pallet-stone for engaging with the same toothed wheel, with two elastic arms connecting the brake lever to a frame which enables it to pivot, and a third elastic element substantially forming a bistable system.

EP Patent No 2037335 A2 in the name of Enzler & Von Gunten, discloses a single piece Swiss lever, with two arms each provided with a pallet-stone, and including arms formed by flexible strips connected to a structure and defining a false pivot.

EP Patent No 2450755 A1 in the name of Nivarox discloses an escape wheel for a timepiece mechanism, including a plurality of toothed wheels, which are coaxial and pivot synchronously about a pivot axis and include at least a first toothed impulse wheel in a first impulse plane and at least a second toothed release wheel in a second stopping plane, parallel to or merged with the first impulse plane. The second toothed release wheel includes at least one moveable assembly which includes, on the one hand, at least one release tooth that is moveable radially relative to the pivot axis and returned to a position of equilibrium by a first return means, and on the other hand, at least one locking tooth returned in a first radial direction towards a stop position by a second return means. The release tooth includes a drive means arranged, when the release tooth moves in a second radial direction opposite to the first radial direction, to cooperate with a complementary drive means comprised in the locking tooth in order to drive the locking tooth in the second radial direction. When the release tooth moves in the first radial direction, the drive means is arranged to move at a distance from the complementary drive means without driving the locking tooth.

EP Patent No 2105806 A1 in the name of Girard Perregaux SA discloses a deformable frame defining two orthogonal axes, including a strip spring buckled in its largest dimension and arranged to restore energy when there are changes in the shape of the bistable strip.

EP Patent No 2 221677 A1 in the name of Rolex SA discloses a detent escapement with a lever pivoting against a spring, which pushes a stop element of said lever towards the escape wheel; the lever carries a release element which cooperates with a release finger carried by a roller whose position is moveable relative to the balance roller under the effect of variations in the velocity of the balance.

CH Patent No 60813 A in the name of Shortill discloses a lever escapement whose escape wheel includes, on both sides of the flange thereof, alternating teeth cooperating with pallet-stones mounted opposite to and facing each other.

EP Patent No 1967919 A1 in the name of ETA SA discloses an escapement with tangential impulses comprising a moveable, ring-shaped frame comprising palette stones arranged to cooperate with the teeth of a moveable escapement located inside the ring.

SUMMARY OF THE INVENTION

The invention proposes to overcome the limitations of known architectures, by proposing compact mechanisms having a small thickness and which are economical to produce.

To this end, the invention concerns a timepiece escapement mechanism including a balance having no roller and an escape wheel, between which impulses are transmitted by a flexible, single-piece mechanism, connected by at least one flexible strip to a fixed structure, or to said wheel, characterized in that the oscillation is maintained by a balance spring ending in a balance spring stud which is mobile during operation, and which is guided by a flexible guide member having flexible strips, said balance spring stud receiving a pin, which is mobile in a cam path of said wheel, and in that, during the oscillations, said balance spring stud moves relative to its locking position under the action of the force exerted by said balance spring, and said pin maintains and regulates the oscillation.

The invention also concerns a timepiece movement including a fixed structure and at least one mechanism of this type.

The invention also concerns a timepiece including a fixed structure and at least one mechanism of this type, and/or at least one timepiece movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
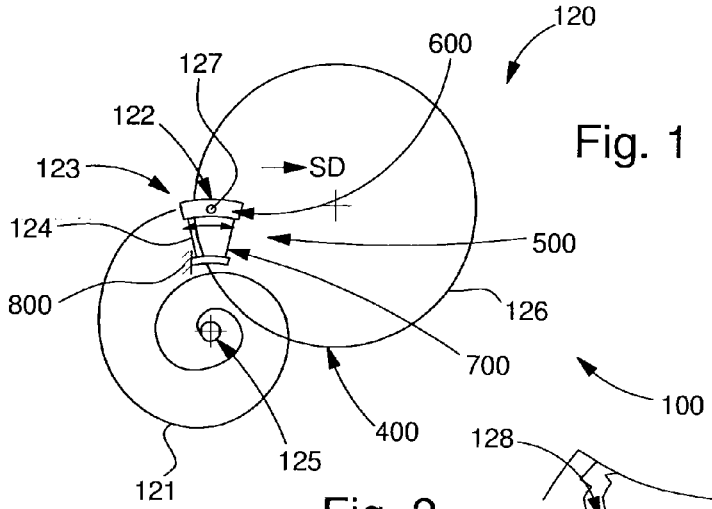
FIG. 1 shows an escapement mechanism with a balance spring according to the invention, including a balance spring stud which is suspended by flexible strips, and which cooperates with a path of an escape wheel.

Numerous timepiece mechanisms may be made, with a reduced number of components, and preferably using components made of silicon, or by a LIGA or DRIE method, comprising flexible areas.

These flexible areas may be used to form guide members, particularly pivot guides, and/or to form elastic return means.

"Flexible guide members" in the following description means linear or rotational guide members comprising one or more flexible strips. These guide members have numerous advantages, of which the following, in particular, may be cited: precision, no friction, no hysteresis, no wear, no requirement for lubrication, no seizing, monolithic manufacturing. The most common limitations are: limitation of movements, low return force or torque density, occasionally complex kinematics, limitation on the load carried.

Flexible guide members may be modified to obtain zero rigidity or to have a bistable state in the case of a component that works by buckling under the action of stresses exerted on both sides of a middle direction, on either side of which the component may occupy two different stable states.

This bistable system may:

be rigid in the absence of a loaded spring;

bistable if a loaded spring applies a high buckling stress to the flexible system;

have zero rigidity if a loaded spring applies an intermediate stress to the guide member, when the relative rigidity passes through the value zero for a load value matching that of the prestress due to the loaded spring.

In a particularly advantageous manner, the invention is applicable to an escape mechanism 100 for a timepiece movement 900 or timepiece 1000 including at least one balance 300 and at least one escape wheel 400.

The invention therefore concerns a timepiece escapement mechanism 100, more particularly an escapement mechanism with a balance spring 120, including a balance 300 having no roller and an escape wheel 400, between which impulses are transmitted by a flexible single-piece mechanism 500, connected by at least one flexible strip 700 to a fixed structure 800 or to wheel 400.

According to the invention, the oscillation is maintained by a balance spring 121 ending in a balance spring stud 122 which is mobile during operation, and which is guided by a flexible guide member 123 with flexible strips 124, said balance spring stud 122 receiving a pin 127 which is mobile in a cam path 128 of wheel 126. During oscillations, balance spring stud 122 is moved relative to its locking position under the action of the force exerted by balance spring 121, and pin 127 maintains and regulates the oscillation.

In a particular embodiment, the flexible guide member 123 with flexible strips 124 is a rotational guide member, having a centre of rotation 125.

In a particular embodiment, centre of rotation 125 is coaxial to balance 300. Other embodiments are possible, particularly with a partially radial movement, in particular in the form of a connecting rod-crank system.

More particularly, the transmission of impulses between said at least one balance 300 and said at least one escape wheel 400 is achieved via a flexible single-piece mechanism 500. This flexible single-piece mechanism 500 includes at least one feeler spindle 600 cooperating with said at least one escape wheel 400 or respectively said at least one balance 300. Flexible single-piece mechanism 500 is connected by at least one flexible strip 700, or preferably by a plurality of flexible strips forming elastic return means, to a fixed structure 800 of said timepiece 1000, or respectively to said at least one escape wheel 400.

FIG. 1 shows an escapement mechanism 120 having a balance spring.

The principle of maintaining and regulating the oscillation of this escapement is very different from the conventional approach. The balance is no longer provided with rollers and the oscillation is maintained via the balance spring stud and the balance spring.

The spiral balance spring 121 ends in a balance spring stud 122 which is mobile during operation. This stud 122 is guided by a flexible guide member 123 having flexible strips 124 and whose centre of rotation 125 coincides with the balance staff. A pin 127 is fixed to stud 122.

Figure 2:
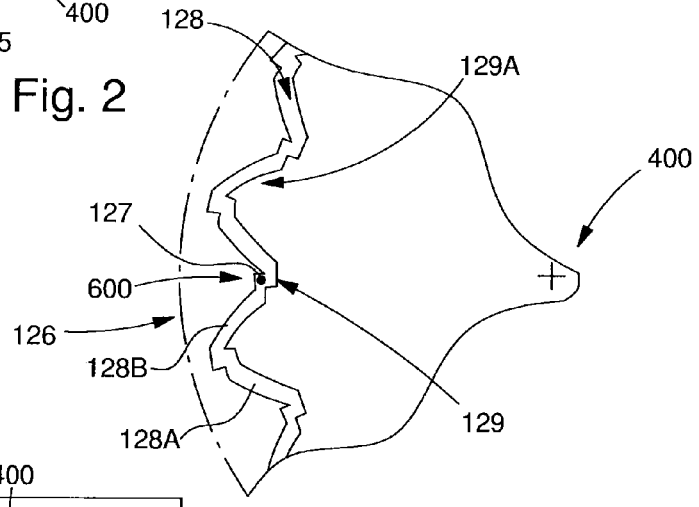
FIG. 2 is a detail of the associated escape wheel, which includes a cam serving as a path for the balance spring stud of FIG. 1.
Figure 3:
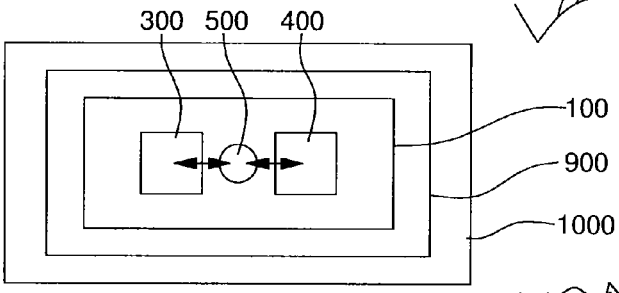
FIG. 3 shows, in the form of block diagrams, a timepiece with a movement including a mechanism of this type.

Escape wheel 126 has no teeth but a path or cam 128, in which pin 127 of the balance spring stud is housed, as seen in FIG. 2. This path 128 includes a succession of ramps 128A, 128B, which are oblique relative to the escape wheel radials, separated by locking positions 129 and exhibiting the appearance of a toothed wheel centred on the axis of the escape wheel, ramps 128A, 128B alternately increasing and decreasing over the periphery of escape wheel 126.

The balance no longer has a roller, and is thus considerably simplified.

If one considers the behaviour of the mechanism without a stud pin and without an escape wheel in this case, during oscillations, stud 122 is moved relative to its locking position under the action of the force exerted thereon by balance spring 121. However, without maintenance, the system stops. In the case of the complete system, stud pin 127, guided in profile 128, fulfils the function of maintaining and regulating the oscillation in the following manner, described during a clockwise motion of the moving balance:

when the balance is in the position which corresponds to FIGS. 1 and 2, with the balance starting its clockwise motion, balance spring stud pin 127 blocks the pivoting of escape wheel 126. Pin 127 cannot move in direction SD, since balance spring 121 is retaining it to the left;

when the balance and the pin are in the locking position, during the clockwise rotation of the balance, just after balance spring 121 passes through the locking position, stud 122 is driven by the balance. Pin 127 is released from its locking position 129 in escape wheel 126 and anticlockwise impulse reloads balance spring 121:

when the balance is at the end of its clockwise travel, once stud pin 127 reaches the next locking point 129A on escape wheel 126, it will not exit therefrom, since the balance continues to retain it in the opposite direction.

In a variant, the energy is supplied to the balance spring stud every second vibration (i.e. at half the frequency).

In a particular variant, the mechanism is excited, via balance spring stud 122 at an integer sub-multiple, or integer multiple of the base frequency of the oscillator.

In a particular embodiment, the mechanism is excited, via balance spring stud 122, at a frequency twice the base frequency of the oscillator.

In a particular variant, the flexible guide member is provided with strips in a bistable position: they have to change from one bistable position to the other during maintenance, which makes it possible to obtain a very fast function, which is a very advantageous property.

For each function to be performed quickly, with a duration of several milliseconds (duration of less than 15 ms if the oscillation frequency is lower than 4 Hz, duration of less than 3 ms if the oscillation frequency is higher than 4 Hz), the mechanism is arranged so that each function is performed during a small rotation of the sprung balance, in particular less than 10% of its amplitude.

In an advantageous embodiment, the stud is made of magnetic material, and micro-magnets are arranged along the profile of the cam path 128 in association with each stop member, to better stabilise the position of stud 122.

In another advantageous embodiment, electrets are arranged along the profile of cam path 128 in association with each stop member (in this case each locking position 129), to better stabilise the position of stud 122. The material of balance spring stud 122 is selected in accordance with the electrets to ensure better stabilisation.

This system takes advantage of the rewinding of the balance spring, which is why the function is very fast.

Figure 4:
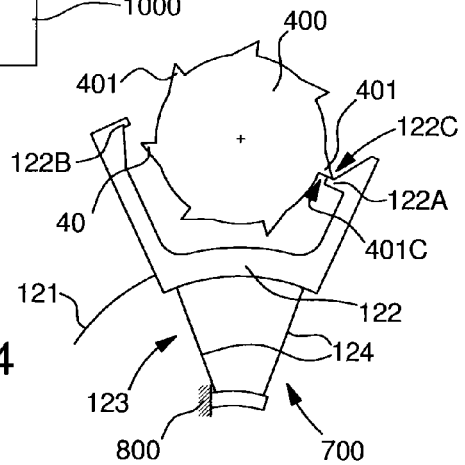
FIG. 4 illustrates a variant with an escape wheel having a single level, and a balance spring stud assembly guided by flexible strips including several lifting pieces.

FIG. 4 illustrates a particular variant with an escape wheel 400 having a single level, which includes peripheral teeth 401, each including a locking surface 401C. A balance spring stud assembly 122 is guided by a flexible guide member 123 having flexible strips 124 and whose centre of rotation 125 coincides with the balance staff. This stud assembly 122 includes several lifting pieces 122A, 122B, each including a locking surface 122C arranged to cooperate in locking abutment with a locking surface 401C of one of teeth 401 of escape wheel 400. FIG. 4 illustrates the case of rotational guiding, with a centre of rotation of the flexible guide member coaxial to the balance staff, which is a particular case. The invention also applies to any type of guide members, particularly linear, and not necessarily to rotational guide members.

The invention also concerns a timepiece movement 900 including at least one flexible mechanism 500 of this type, and in particular including a fixed structure 800 and at least one mechanism 100 of this type.

The invention also concerns a timepiece 1000, in particular a watch, including at least one timepiece movement 900 of this type, and/or at least one flexible mechanism 500 of this type, in particular including a fixed structure 800 and at least one mechanism 100 of this type.

The invention claimed is:

1. A timepiece escapement mechanism comprising:

a fixed structure;

a balance and an escape wheel;

a flexible, single-piece mechanism configured to transmit impulses between the balance and the escape wheel, the single-piece mechanism including at least one flexible strip which connects the flexible, single-piece mechanism, to the fixed structure or the escape wheel;

a balance spring configured to maintain oscillation and which ends in a balance spring stud arranged to move during operation, and the balance spring stud is guided by a flexible guide member including flexible strips, the balance spring stud receiving a pin configured to cooperate with a cam path of the escape wheel, and wherein the balance spring stud is subjected to a force exerted by the balance spring, the force tending, during the oscillation, to move the balance spring stud relative to a locking position thereof, and imparting a motion to the pin to maintain and regulate the oscillation without use of a balance roller.

2. The timepiece escapement mechanism according to claim 1, for a timepiece movement or a timepiece including the balance and the escape wheel, wherein transmission of the impulses between the balance and the escape wheel is performed by the single-piece, flexible mechanism, comprised in the escapement mechanism and including at least one feeler-spindle cooperating with the escape wheel or respectively the balance, and wherein the single-piece, flexible mechanism is connected by the at least one flexible strip comprised therein to the fixed structure of the timepiece or respectively to the escape wheel, and wherein the oscillation is maintained without use of the balance roller via the balance spring stud and the balance spring, which ends in the balance spring stud, which is mobile during operation, and which is guided by the flexible guide member including the flexible strips, the pin being fixed to the balance spring stud, the escapement mechanism including the escape wheel with the cam path in a shape of a set of teeth where the balance spring stud pin is housed, the escapement mechanism configured such that, during the oscillation, the stud moves relative to the locking position thereof under action of the force exerted thereon by the balance spring, and such that the balance spring stud pin, guided in a profile, fulfils a function of maintaining and regulating the oscillation, so that, during a clockwise motion of the balance:

when the balance is in a first position wherein the balance starts the clockwise motion, the stud pin is arranged to block pivoting of the escape wheel, the pin being retained by the balance spring;

when the balance and the pin are in the locking position, during clockwise rotation of the balance, just after the balance spring passes through the locking position, the balance spring stud is configured to be driven by the balance, and the pin is configured to be released from a locking point comprised in the escape wheel, and the balance spring configured to be reloaded by an anticlockwise impulse;

when the balance is at an end of clockwise travel, the stud pin is configured, once the pin reaches a next locking point on the escape wheel to remain there, retained by the balance in an opposite direction.

3. The timepiece escapement mechanism according to claim 1, wherein the escapement mechanism is excited, via the balance spring stud, at a frequency half a base frequency of the oscillation, by supplying energy to the balance spring stud every second vibration.

4. The timepiece escapement mechanism according to claim 3, wherein the escapement mechanism is excited, via the balance spring stud, at an integer sub-multiple or integer multiple frequency of the base frequency of the oscillation.

5. The timepiece escapement mechanism according to claim 1, wherein the flexible guide member including the flexible strips is a rotational guide member about a center of rotation.

6. The timepiece escapement mechanism according to claim 5, wherein the center of rotation is coaxial to the balance.

7. The timepiece escapement mechanism according to claim 1, wherein the flexible guide member includes strips in a bistable position, which change from a first bistable position to a second bistable position during maintenance, to ensure performance of a function in less than a millisecond.

8. The timepiece escapement mechanism according to claim 1, wherein, for each function to be performed with a duration of less than fifteen milliseconds, the escapement mechanism is configured so that each function is performed during a rotation of the balance that is sprung of less than 10% of an amplitude thereof.

9. The timepiece escapement mechanism according to claim 1, wherein the balance spring stud is made of magnetic material, and micro-magnets are arranged along a profile of the cam path, in association with each locking point comprised in the escape wheel, to better stabilize a position of the balance spring stud.

10. The timepiece escapement mechanism according to claim 1, wherein electrets are arranged along a profile of the cam path, in association with each locking point comprised in the escape wheel, to better stabilize a position of the balance spring stud.

11. A timepiece movement comprising the fixed structure and at least one of the timepiece escapement mechanism according to claim 1.

12. A timepiece including the fixed structure and at least one of the timepiece escapement mechanism according to claim 1.

13. A timepiece including the fixed structure and at least one of the timepiece movement according to claim 11.

* * * * *